US006584819B1

(12) United States Patent
Hung

(10) Patent No.: US 6,584,819 B1
(45) Date of Patent: Jul. 1, 2003

(54) LOCK WITH TWO LAYERS OF LOCK MECHANISM

(76) Inventor: Chung-I Hung, P.O. Box 96-405, Taipei 106 (TW)

( * ) Notice: Subject to any disclaimer, the term of this patent is extended or adjusted under 35 U.S.C. 154(b) by 0 days.

(21) Appl. No.: 10/071,618

(22) Filed: Feb. 6, 2002

(51) Int. Cl.[7] ..... E05B 27/08; E05B 29/04

(52) U.S. Cl. ..... 70/491; 70/358; 70/366; 70/375; 70/404; 70/409

(58) Field of Search ..... 70/491, 493, 358, 70/395, 365, 366, 495, 496, 409, 408, 375, 400, 401, 403, 404, 407

(56) References Cited

U.S. PATENT DOCUMENTS 1,851,986 A * 4/1932 Rubsamen
1,892,419 A * 12/1932 Best
2,101,779 A * 12/1937 Kenney
2,176,465 A * 10/1939 Merkl
2,247,621 A * 7/1941 Speer
2,298,697 A * 10/1942 Hofmann
2,298,698 A * 10/1942 Hofmann
2,528,964 A * 11/1950 Lurtz
3,008,322 A * 11/1961 Stackhouse
4,100,777 A * 7/1978 Fredon ..... 70/398 X
4,370,875 A * 2/1983 Piiroinen ..... 70/422
4,838,061 A * 6/1989 Tai-Seng ..... 70/493
5,595,080 A * 1/1997 Whinton ..... 70/432

FOREIGN PATENT DOCUMENTS

DE 708993 * 8/1941 ..... 70/366

* cited by examiner

*Primary Examiner*—Lloyd A. Gall
(74) *Attorney, Agent, or Firm*—Troxell Law Office PLLC

(57) ABSTRACT

A lock with two layers of lock mechanism, which comprises a body casing, an upper lock body, a lower lock body, a connection plate and a key; the chamber of the body casing is used for mounting the two lock bodies; the two lock bodies are connected together with the connection plate; the center of the upper lock body has a key hole for receiving a flat key to plug into a key hole of the lower lock body; the other end of the key has a cylindrical key, which is to be plugged into a ring-shaped key groove; when the key is pushed and turned, both the upper and lower lock bodies will be unlock simultaneously.

9 Claims, 7 Drawing Sheets

LOCK WITH TWO LAYERS OF LOCK MECHANISM

BACKGROUND OF THE INVENTION

1. Field of the Invention

This invention relates to a lock device, and particularly to a lock with two layers of lock mechanism.

2. Description of the Prior Art

In a conventional cylindrical lock, the inner space of the casing is mounted with an upper tumbler seat and a lower tumbler seat; a plurality of symmetrical tumbler holes are furnished between the upper and lower tumbler seats to be loaded with tumblers and springs respectively; normally, the springs in the tumbler holes will push the front ends of the front tumblers to the positioning edge of the front end of the casing. Since the tumblers are different in length, they can mate with different keys for unlocking; after a correct key is plugged into the cylindrical lock, the unlock grooves on the front end of the cylindrical lock will push the front tumblers to move forwards to an interface between the upper tumbler seat and the lower tumbler seat, i.e., the front tumblers and the rear tumblers are put along a rotary tangent surface; then, a turning and driving plate of the cylindrical key will drive the upper tumbler seat to turn, and a transmission shaft of the upper tumbler seat will drive a driving arm to turn.

In a conventional lock device, the lock lamina or the lock tumblers mounted in a body casing are different in structure, and the key for unlocking the same is also different in structure; therefore, the lock-up function is also different. In the conventional laminated lock structure, the assembling procedures thereof is rather simple aside from the picklock factors; it can obtain a high manufacturing precision without being unlocked with a master key.

In the conventional locks, different locks are substantially different in the structure of their tumblers, i.e., each type of lock has its features; after a given period of being sold, the locking function thereof is subject to being learned or known by other person, and then it is subject to being unlocked easily.

SUMMARY OF THE INVENTION

The prime object of the present invention is to provide a lock device, in which a body casing is loaded with two different lock bodies, and the two lock bodies are connected together with a connection plate; the key of such a lock must be able to unlock the two different lock bodies simultaneously so as to drive the core bar in the lock to turn.

Another object of the present invention is to provide a lock device, in which the cylindrical hole is furnished with a key hole through the lower lock body; one end of the cylindrical hole and the body casing is furnished with a ring-shaped key groove for receiving a cylindrical key; the center of the cylindrical key has a flat key. During unlocking the lock, the flat key has to plug into the lower lock body, while the cylindrical key is plugged into the upper lock body so as to have the upper and lower tumblers and the lock lamina driven to the unlocking positions; then, the key can drive the core bar to turn.

Still another object of the present invention is to provide a lock device, in which the front part of the cylindrical hole is loaded with the upper lock body, while the rear part thereof is mounted with the lower lock body; the upper and lower lock bodies are connected together with a connection plate. The two lock bodies in the body casing should be unlocked with a key simultaneously so as to have the core bar to turn.

A further object of the present invention is to provide a lock device, in which the center of the connection plate is mounted on a movable member of the upper lock body; the outer edge of the connection plate is furnished with a limit groove and a guide groove for receiving one end of the bolt. After the key is plugged in to unlock the lock, the limit groove of the connection plate will connect with and limit the bolt to have the two lock bodies connected together so as to turn the core bar for unlocking.

A still further object of the present invention is to provide a lock device, in which the center of the lower lock body has a key hole, being smaller than that of the upper lock body so as to facilitate the key to plug in smoothly.

Yet another object of the present invention is to provide a lock device, in which the lower lock body is a laminated lock cylinder or the like, while the upper lock body is a cylinder-shaped lock core or the like.

DETAILED DESCRIPTION OF THE PREFERRED EMBODIMENT

Figure 1:
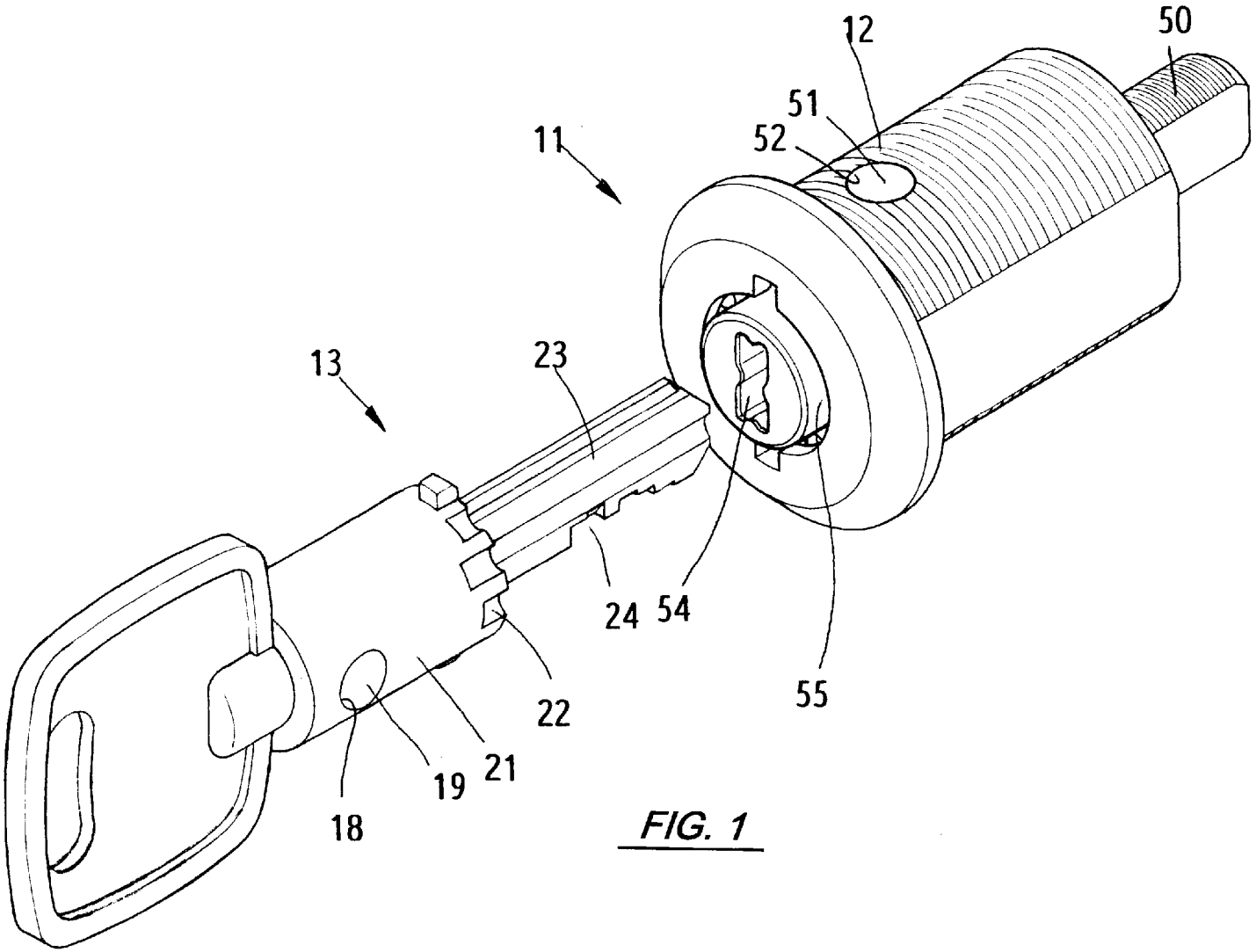
FIG. 1 is a perspective view of the present invention, showing the relation between the lock and the key thereof.
Figure 2:
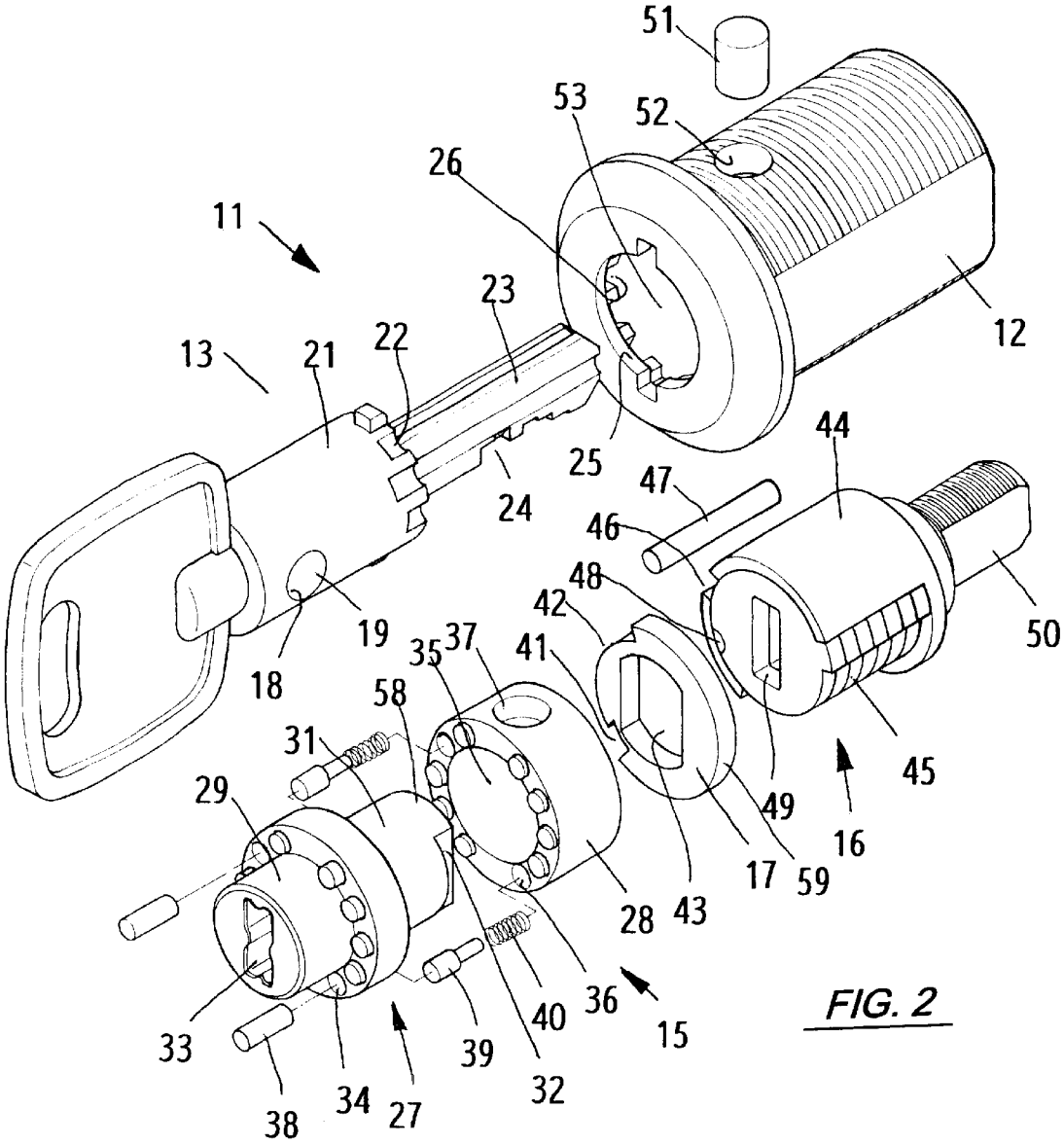
FIG. 2 is a disassembled view of the present invention, showing the relation between the inner parts in the body casing and the transmission assembly.
Figure 3:
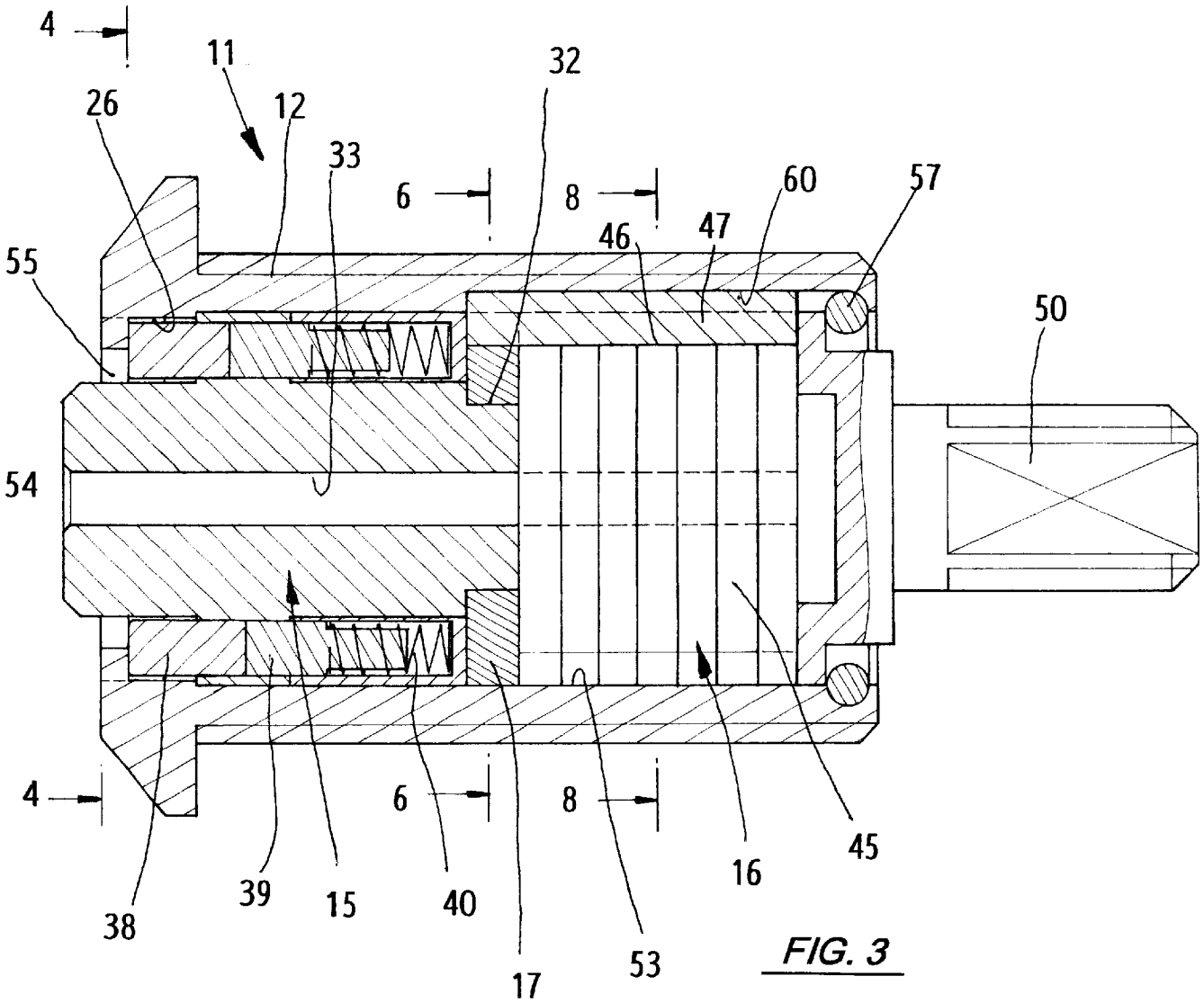
FIG. 3 is a sectional view of the present invention, showing the structure of inner assemblies in the body casing.
Figure 4:
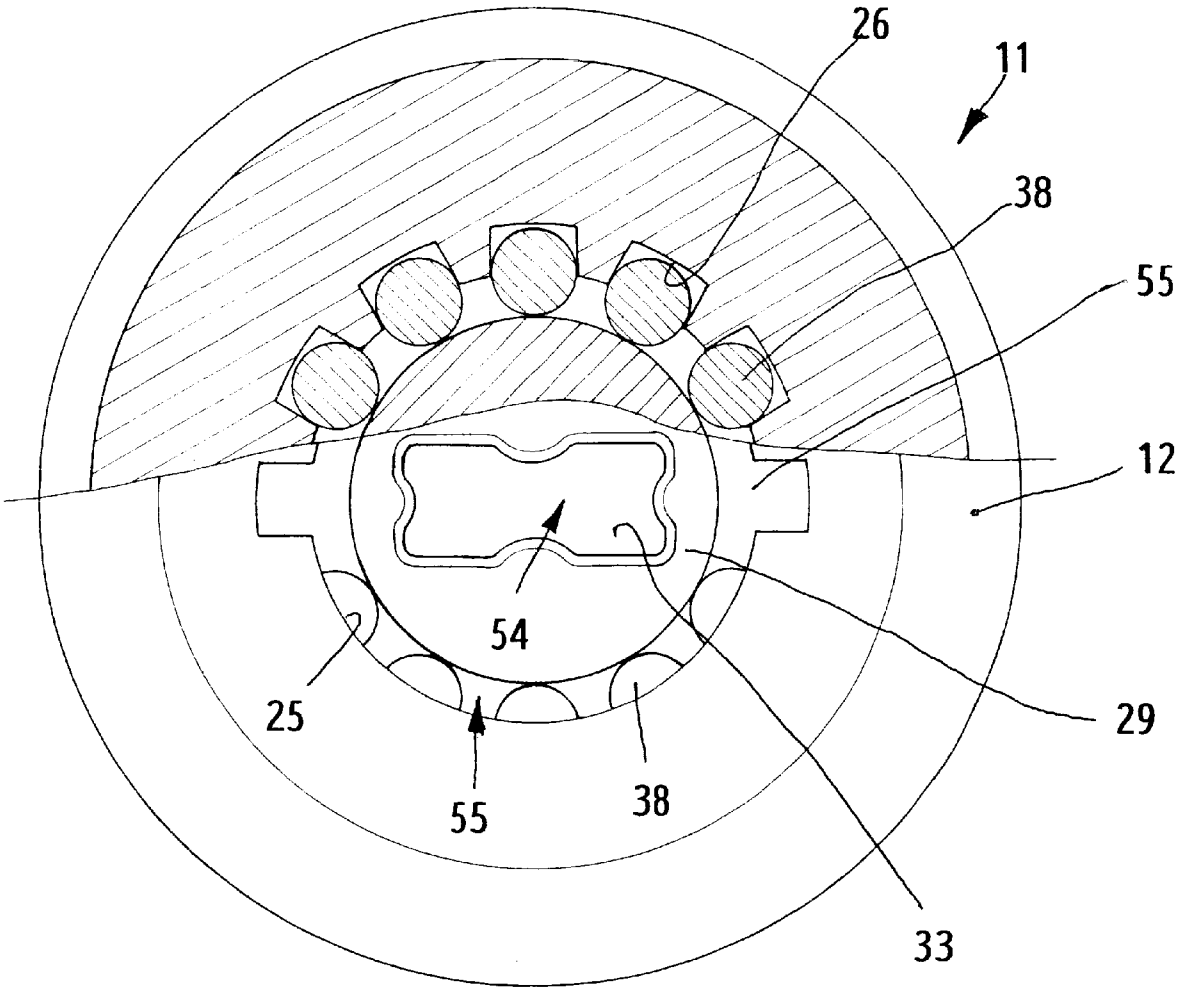
FIG. 4 is a sectional view of the present invention, showing the structure along line 4—4 in FIG. 3.

This invention relates to a lock with two layers of lock mechanism; as showing in FIGS. 1 to 3, the center of the body casing 12 of the lock 11 is furnished with a cylindrical hole 53 to be mounted with an upper lock body 15 and a lower lock body 16. The center of the front end plate of the body casing 12 has a round hole 25; the two lock bodies 15 and 16 are mounted in correct order into the cylindrical hole 53. The center of the lock 11 has a keyhole 54 and a ring-shaped key groove 55; the keyhole 54 is used for receiving a flat key 23 to go through a key hole 49 of the lower lock body 16 for unlocking the lock. The ring-shaped key groove 55 is to be plugged with a cylindrical key 21 so as to push the upper lock body 15 for unlocking. A connection plate 17 is furnished between the two lock bodies 15 and 16 so as to have the two lock bodies 15 and 16 connected together, and to have the upper and lower lock bodies 15 and 16 to move synchronously to turn the core bar 50.

As shown in FIGS. 1 to 4, the body casing 12 is furnished with threads on outer surface so as to facilitate the lock 11 mounted in place; one end of the body casing 12 is furnished with a cylindrical hole 53 in the center thereof; the bottom end of the cylindrical hole 53 has a through round hole 25 and a guide groove for receiving a key. After the lock body 15 is mounted into the cylindrical hole 53 of the body casing 12, it can be fixed in place by means of a short pin 51 plugged in a through round hole 52 in the body casing 12, and a positioning hole 37 of a fixed member 28 of the lock body 15; then, a ring-shaped key groove 55 will be formed by means of the round hole 25 of the body casing 12 and a round stem 29 on front end of the lock body 15 so as to facilitate a cylindrical key 21 to plug in.

The bottom of the cylindrical hole 53 of the body casing 12 is furnished with symmetrical catch grooves 26, which are designed to fit the cylinder-shaped lock body 15. After the lock body 15 is mounted in the cylindrical hole 53 of the body casing 12, the ends of the upper tumblers 38 of the lock body 15 will be set therein; the lower tumblers 39 in the lock body 15 can provide a catch function between the movable member 27 and the fixed member 28; further, the upper tumblers 38 can also provide a catch function between the movable member 27 and the catch grooves 26 in the cylindrical hole 53 of the body casing 12 so as to prevent the lock from demolition by a picklock.

The lock body 15 mounted in the front end of the body casing 12 is substantially a conventional cylinder-shaped member, while the lock body 16 in the rear end of the body casing is a laminated lock cylinder; the two lock bodies 15 and 16 are mounted on one center line; the key 13 for unlocking the lock 11 is a key designed to fit the two lock bodies 15 and 16. The center of the movable member 27 of the lock body 15 has a through key hole 33 to facilitate a flat key 23 to plug in. Since the key 13 must be able to unlock the two lock bodies 15 and 16 simultaneously, it includes a cylindrical key 21 and a flat key 23. The center of the cylindrical key 21 is furnished with a plug groove (not shown) for receiving the flat key 23. The outer surface of the key 13 has a round hole 18 for receiving a pin 19 upon the flat key 23 being plugged into the center of the cylindrical key 21 so as to assemble the two keys together; then, the center of the flat key 23 and the cylindrical key 21 are aligned on one center line; one end of the cylindrical key 21 is furnished with key grooves 22 for unlocking the lock body 15, and the key grooves 22 have different heights from one another so as to provide the lock body 15 with a wide variety in terms of code. The flat key 23 in the center of the cylindrical key 21 is furnished with symmetrical key grooves 24 on both sides thereof, and the key grooves 24 are designed to mate with the curved grooves 48 of the lock laminae 45 respectively. When a key 13 is plugged into the two lock bodies 15 and 16, the flat key 23 will first pass through the key hole 33 of the lock body 15 and the key hole 49 of the lock body 16; then, every key groove 24 of the flat key 23 will opposite every piece of the lock lamina 45 respectively, while every key groove 22 of the cylindrical key 21 will mate with every upper tumbler 38 of the lock body 15; then, the key grooves 22 will push the upper tumblers 38 to move inwards until all the upper and lower tumblers 38 and 39 moving to a common contact surface between the movable member 27 and the fixed member 28; in that case, the cylindrical key 21 will drive the movable member 27 to turn; almost simultaneously, every lock lamina 45 of the lock body 16 will mate with every key groove 24 of the flat key 23; before turning, the lock body 15 must be unlocked first so as to enable the key to turn. After every lamina 45 of the lock body 16 is set in correct code, the flat key 23 will drive the curved groove 48 of every lock lamina 45 to the corresponding groove of the lock cylinder 44 so as to have the bolt 47 moved out of the catch position; then, the key 13 can drive the core bar 50 to turn; in case of one of the lock laminae 45 not being set in the correct code position, the bolt 47 can not be moved to the unlocked position, and the core bar 50 can not be turned.

The lock body 15 in the front end of the cylindrical hole 53 of the body casing 12 is substantially a conventional lock cylinder, which includes a movable member 27, a fixed member 28 and a plurality of upper tumblers 38 and lower tumblers 39, and springs 40; the center of the fixed member 28 has a cylindrical hole 35 for receiving the round stem 31 of the movable member 27; one end of the round stem 31 is mounted in the fixed member 28; the round stem 31 has a short round stem 58 which includes two symmetrical plane surfaces 32 to be mounted with a connection plate 17 so as to have the lock body 15 and the lock body 16 connected together.

Between the movable member 27 and the fixed member 28 of the lock body 15, there is a common contact surface, which is furnished with a plurality of opposite tumbler holes 34 and 36 for receiving springs 40, the upper tumblers 38 and lower tumblers 39 respectively. When the lock body 15 is in locked condition, the lower tumblers 39 and the upper tumblers 38 extend out of the common contact surface as a result of the pushing force of the springs 40; a plurality of the upper tumblers 38 extend with one end, into the catch grooves 26 respectively; the other ends of the upper tumblers 38 are mounted in the upper tumbler holes 34 of the movable member 27 respectively, while the lower tumblers 39 are stayed on a rotary contact surface between the movable member 27 and the fixed member 28. The lock body 15 can be unlocked by means of the key grooves 22 on the front end of the cylindrical key 21 to push the upper and lower tumblers 38 and 39 to the rotary contact surface between the movable member 27 and the fixed member 28 simultaneously; then, the cylindrical key 21 can be turned to unlock the lock.

As shown in FIGS. 2, 3, 5, and 8 to 10, the lock body 16 mounted on the rear end of the cylindrical hole 53 of the body casing 12 is a laminated lock cylinder, which includes a lock cylinder 44, a plurality of lock laminae 45 and a bolt 47; the center of the lock cylinder 44 is furnished with a cylindrical chamber for receiving a plurality of lock laminae 45. The vertical center of the lock cylinder 44 has a groove 46, while one end of the lock cylinder 44 is furnished with a core bar 50. The center of the lock laminae 45 is furnished with a through key hole 49. The outer edge of every lock lamina 45 is furnished with a curved groove 48 which is different from that of the other curved grooves 48. The lock body 16 is mounted in the cylindrical hole 53 of the body casing 12; the cylindrical hole 53 has a semi-circular bolt groove 60 opposite to the groove 46 of the lock cylinder 44. The bolt groove 60 is used for mounting a part of the bolt 47 therein upon the lock body 16 being mounted in place, while the other part thereof is mounted in the groove 46 of the lock cylinder 44; the bolt 47 is to be mounted between the body casing 12 and the lock cylinder 44 for controlling the unlocking function of the lock cylinder 44. After the flat key 23 is plugged into the key hole 49 of the lock body 16, every key groove 24 of the flat key 23 will mate with every corresponding lock lamina 45 so as to drive every lock lamina 45 to turn, i.e., to have the curved groove 48 of every lock lamina 45 moved to a position opposite to the groove 46 of the lock cylinder 44, and to provide the bolt 47 with more space to move; then, the flat key 23 continues to turn so as to have the curved groove 48 of every lock lamina 45 moved into the groove 46 of the lock cylinder 44 upon the bolt 47 moving; then, the bolt 47 will be moved into the groove 46 of the lock cylinder 46, and into the curved grooves 48 of the lock laminae 45 aligned; in that case, the flat key 23 can be turned further so as to drive the whole lock body 16 to turn for unlocking.

The cylindrical hole 53 of the body casing 12 of the lock 11 is to be mounted with two different lock bodies 15 and 16. The lock body 16 mounted in the rear end of the cylindrical hole 53 has a passage for receiving the flat key 23 in the center of the lock body 15; the passage is furnished in the key hole 33 of the movable member 27 to enable the flat key 23 of the key 13 to go through the key hole 33 so as to unlock the lock.

The two lock bodies 15 and 16 in the cylindrical hole 53 are connected together so as to enable the key to unlock two different lock bodies simultaneously, and to drive the core bar 50 to turn. The inner end of the movable member 27 of the lock body 15 has a round stem 31 with a short round stem 58, which has two symmetrical plane surfaces 32 to be mounted with a connection plate 17 on the outer end of the fixed member 28, and the connection plate has a mounting hole 43. The end surface of the connection plate 17 is slightly higher than or equal to that of the short round stem 58 of the movable member 27. After the lock body 16 is mounted in place, the outer surface of the mounting hole 43 is in close contact with the end of the lock cylinder 44 of the lock body 16, and with the lock lamina 45. After the retaining ring 57 of the lock body 16 is mounted in a retaining ring groove of the cylindrical hole 53 of the body casing 12, the lock body 15, the connection plate 17 and the lock body 16 will be mounted firmly in the cylindrical hole 53 of the body casing 12.

The connection plate 17 is mounted on the short round stem 58 of the movable member 27 of the lock body 15; as shown in FIGS. 2,3, 6 and 7, the outer surface of the connection plate 17 has an unlock groove 41 and a curved portion 42, and is in contact with the ring surface 59 of the cylindrical hole 53. The cylindrical hole 53 is furnished with a bolt groove 60 opposite to the unlock groove 41 of the connection plate 17, and the bolt 47 is to be mounted therein; the depth of the curved portion 42 is equal to the height of the projected part of the bolt 47 out of the bolt groove 60. The width of the curved portion 42 is designed to fit the maximum moving extent of the lock laminae 45 in the lock body 16 upon unlocking operation. The width of the unlock groove 41 beside the curved portion 42 is designed to mate with the width of the groove 46 of the lock cylinder 44, and the depth thereof is equivalent to the depth of curved grooves 48 of the lock laminae 45 so that the bolt 47 can be received between the lock body 16 and the connection plate 17. Before the lock 11 being unlocked, the bolt 47 is set in the bolt groove 60 of the cylindrical hole 53 of the body casing 12, in the groove 46 of the lock cylinder 44 of the lock body 16, and in the curved portion 42 of the connection plate 17 so as to prevent the lock cylinder 44 of the lock body 16 from turning, and to prevent the core bar 50 from moving.

Figure 5:
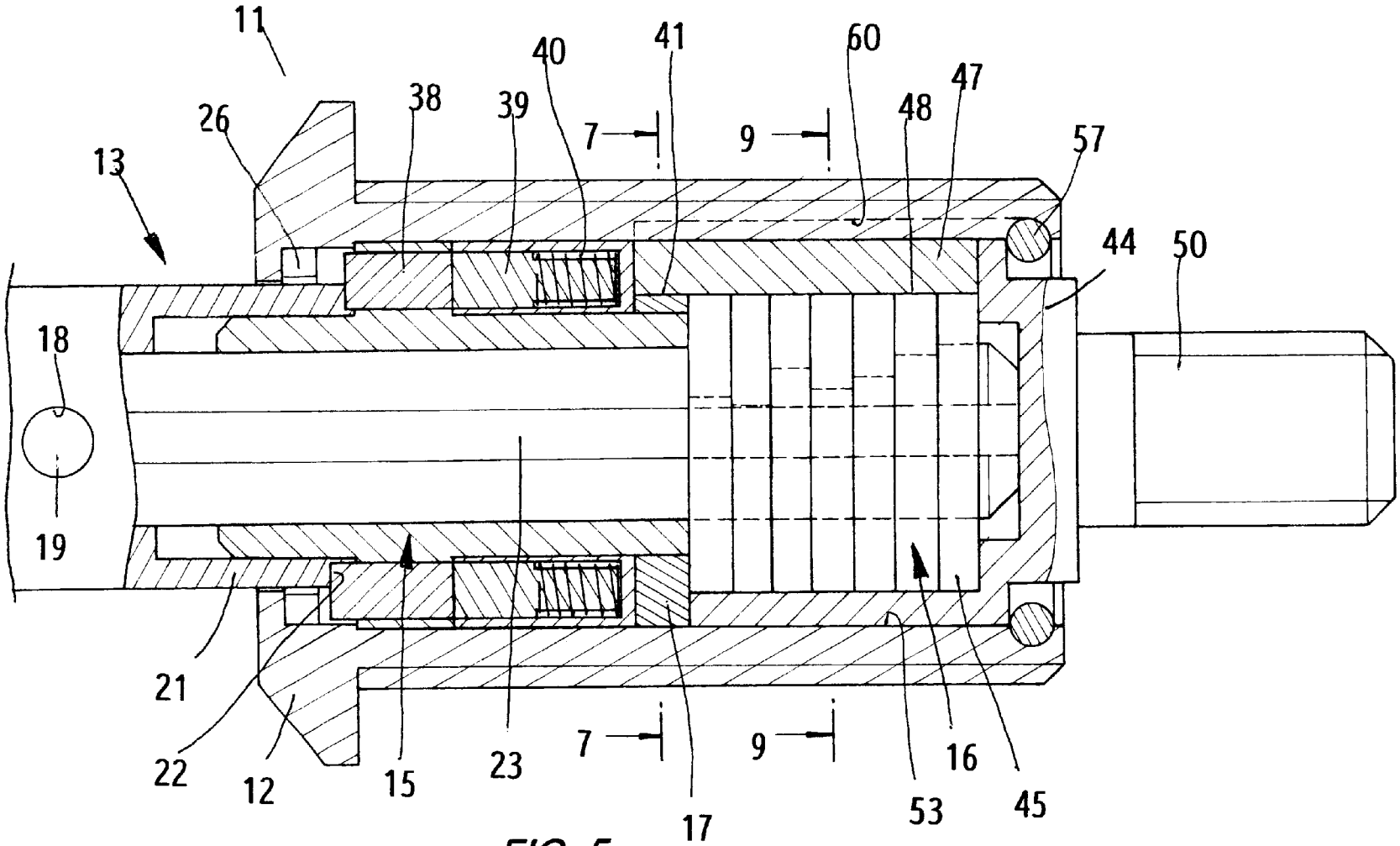
FIG. 5 is a sectional view of the present invention, showing a key inserted in the lock body for unlocking.
Figure 6:
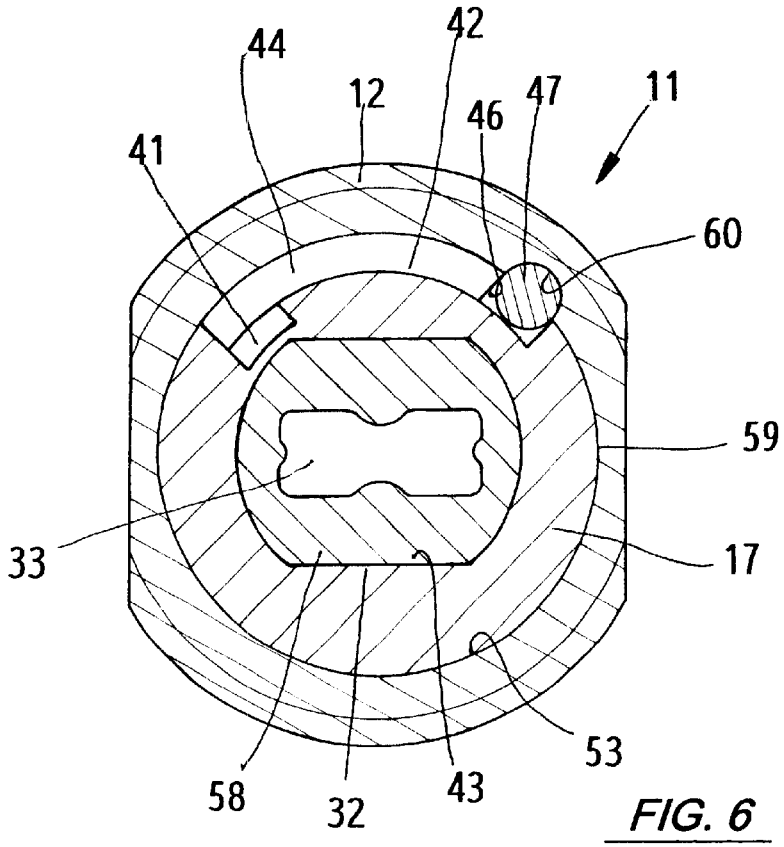
FIG. 6 is a sectional view of the present invention, showing the structure along line 6—6 in FIG. 3.
Figure 8:
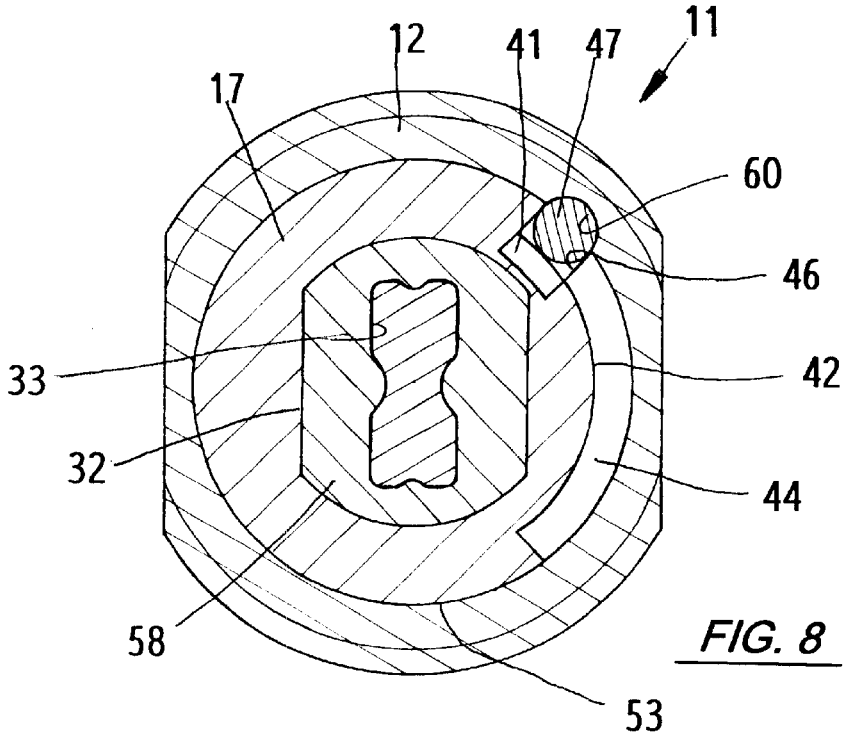
FIG. 8 is a sectional view of the present invention, showing the structure along line 8—8 in FIG. 3.
Figure 7:
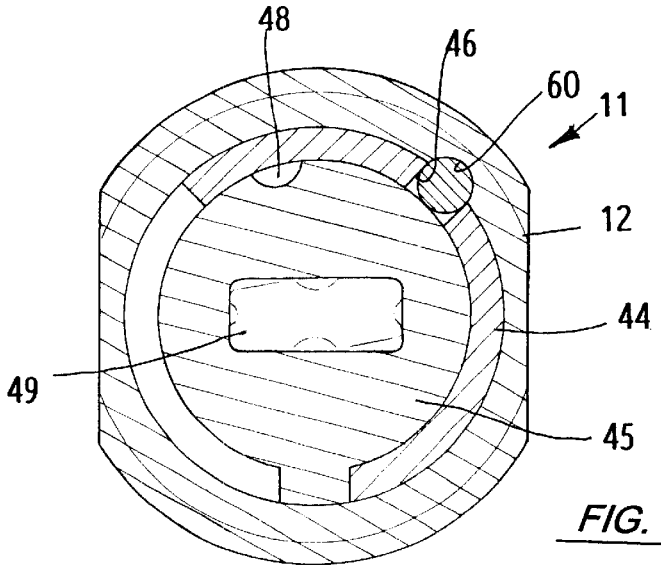
FIG. 7 is a sectional view of the present invention, showing the structure along line 7—7 in FIG. 5.
Figure 9:
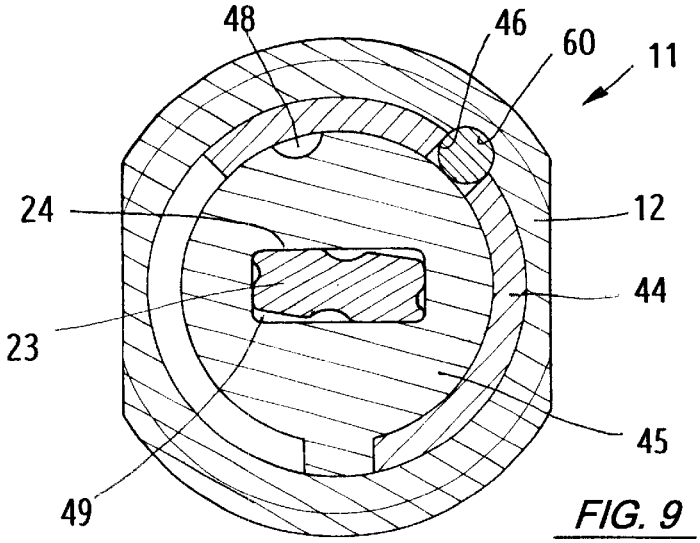
FIG. 9 is a sectional view of the present invention, showing the structure along line 9—9 in FIG. 5.
Figure 10:
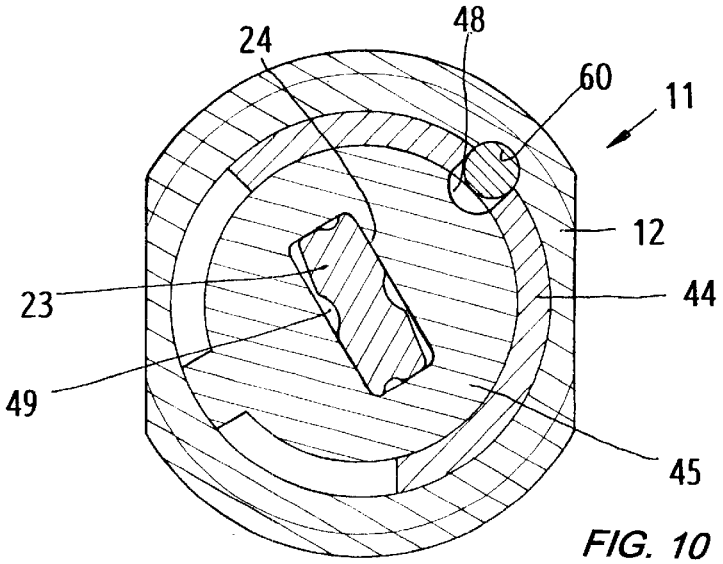
FIG. 10 is a sectional view of the present invention, showing the structure as showing in FIG. 9 to turn continuously.

When the key 13 is unlocking the locking bodies 15 and 16, the key grooves 22 of the cylindrical key 21 will push the upper tumblers 38 towards a rotary contact surface (as shown in FIG. 5) between the movable member 27 and the fixed member 28, and simultaneously the catch grooves 24 of the flat key 23 will go through the key hole 33 of the lock body 15 to the key hole 49 of the lock body 16; the key 13 first drives the lock body 15 to turn; the connection plate 17 on the short round stem 58 of the movable member 27 will also turn; the bolt 47 in the bolt groove 60 of the cylindrical hole 53 would not hinder the connection plate 17 to turn, and to contact with the curved portion 42 and to move (as shown in FIG. 6); then, the curved groove 48 of every lock lamina 45 in the lock cylinder 44 of the lock body 16 will be turned, as a result of the key groove 24 thereof, to a position opposite to the groove 46 of the lock cylinder 44 so as to provide the bolt 47 with a space to move out of the bolt groove 60. When the key 13 is turned continuously, the bolt 47 will be moved from a space between the groove 46 and the bolt groove 60 of the body casing 12 into another space between the groove 46 of the lock cylinder 44 and the curved grooves 48 of the lock laminae 45; then, the key 13 can drive the core bar 50 of the lock body 16 to turn.

The connection plate 17 is mounted between the two lock bodies 15 and 16; when the flat key 23 is plugged through the key holes 49 of all the lock laminae 45, the key grooves 24 of the flat key 23 will be set in their correct code positions respectively; in case of one code being incorrect, the curved groove 48 of the incorrect lock lamina 45 will not turn to the opposite position of the groove 46 of the lock cylinder 44 upon the flat key 23 moving to the last point; in that case, the bolt 47 will remain in its original position to cause the core bar 50 not to turn for unlocking the lock.

When the flat key 23 and the cylindrical key 21 are used to unlock the two lock bodies 15 and 16, the cylindrical key 21 will first turn and drive the connection plate 17 on the tail end of the movable member 27 to turn; then, every lock lamina 45 of the lock body 16 will move to its code position; as soon as the curved groove 48 of every lock lamina 45 turn to a position opposite to the groove 46 of the lock cylinder 44, the bolt 47 will move along the curved portion 42 of the connection plate 17 to the unlock groove 41; then, the bolt 47 is set across the groove 46 of the lock cylinder 44 and the connection plate 17; in that case, the space between the curved groove 48 of every lock lamina 45 and the unlock groove 41 of the connection plate 17 will be increased by means of the space between the groove 46 of the lock cylinder 44 and the curved portion 42 of the connection plate 17, and then the bolt 47 will have more space to move out of the catch position so as to enable the key 13 to turn further for driving the core bar 50 to turn and to unlock the lock.

In the cylindrical hole 53 of the body casing 12, two different lock bodies 15 and 16 are loaded; the two different lock bodies 15 and 16 have different 15 unlocking methods by using a cylindrical key 21 and a flat key 23 simultaneously, i.e., the two lock bodies 15 and 16 can be unlocked at the same time by aligning the code position and turning.

In order to prevent the lock from being unlocked with a single flat key to plug into the key hole 33 to turn with force to demolish the lock, a connection plate 17 mounted between the two lock bodies 15 and 16 and a bolt 47 mounted in a long space (i.e., the bolt groove 60) are furnished; in that case, a single flat key may be set in the correct code position, but the bolt 47 is still controlled with the lock body 15 and the connection plate 17, i.e., the bolt 47 is caught on the rotary contact surface without moving, and therefore the core bar 50 in the lock cylinder 44 is still in locked condition.

The lock body 15 on the front end of the body casing 12 might be demolished intentionally so as to remove the resistance of the connection plate 17; in order to prevent the aforesaid possible case, the bottom of the cylindrical hole 53 is furnished with symmetrical catch grooves 26 so as to have the upper tumblers 38 pushed against the catch grooves 26 respectively with springs 40 upon the lock body 15 under locked condition; in case of the upper tumblers 38 being demolished, the upper tumblers must be pushed first; otherwise, the upper tumblers 38 would stay between the movable member 27 and the catch grooves 26; it would be very difficult to have the movable member 27 turned or demolished with force; moreover, a flat key 23 is necessary to plug through the key hole 33 of lock body 15 and into the lock body 16 before demolishing the lock body 16, but it would be a very difficult job.

The present invention comprises two different lock bodies 15 and 16, which are mounted together with a connection plate 17; a plurality of catch grooves 26 are furnished between the lock body 15 and the body casing 12 so as to increase the safety of the two layer type of lock; to unlock the lock 11, a correct and fit key 13 must be used for driving the core bar 50 to turn.

According to the description of the aforesaid embodiment, the features and structure of the present invention have been disclosed completely, and it is apparent that the present invention has made an obvious improvement for the kind; it is never anticipated and accomplished by any person in the field; therefore, the structure thereof is deemed unique.

What is claimed is:

1. A lock with two locking mechanisms comprising:

a body casing which includes a space for mounting two lock bodies, said body casing having a cylindrical hole and an end of said body casing having a round hole communicating with the cylindrical hole;

an upper lock body mounted in the cylindrical hole of said body casing;

a lower body mounted on an inner end of said cylindrical hole of said body casing, an outer end of said lower lock body including a core bar extending from the body casing;

a connection plate mounted between the upper and lower lock bodies, and including an unlock groove and a curved portion on an outer edge thereof, one end of a bolt of said lower lock body mounted across a surface of said curved portion; and a key including a cylindrical key and a flat key, and said flat key passing through a key hole of said upper lock body and a key hole of said lower lock body.

2. The lock with two lock mechanisms as claimed in claim 1, wherein said upper lock body is substantially a cylinder-shaped core.

3. The lock with two lock mechanisms as claimed in claim 1, wherein said lower lock body is a laminated lock cylinder with a plurality of lock lamina.

4. The lock with two lock mechanisms as claimed in claim 2, wherein said cylinder-shaped lock body has a movable member with a key hole for receiving a flat key.

5. The lock with two lock mechanisms as claimed in claim 1, further comprising a round stem with a short round stem on a rear end thereof; said short round stem having two symmetrical plane surfaces mounted with a mounting hole of said connection plate.

6. The lock with two lock mechanisms as claimed in claim 3, wherein a depth of said curved portion of said connection plate is equal to height of a portion of said bolt projected above a bolt groove, and a width of said curved portion being designed in accordance with a maximum moving distance of said lock lamina of said lower lock body.

7. The lock with two lock mechanisms as claimed in claim 3, wherein said connection plate has an unlock groove, and a width of said unlock groove is equal to that of a groove of said laminated lock cylinder, a depth thereof being equal to that of curved grooves of said lock lamina.

8. The lock with two lock mechanisms as claimed in claim 3, wherein said laminated lock cylinder is mounted in said cylindrical hole of said body casing, and said cylindrical hole has a bolt groove for receiving a bolt; said bolt groove mounted along surface of said connection plate, and said bolt mounted across said curved portion of said connection plate.

9. The lock with two lock mechanisms as claimed in claim 2, wherein one end of said cylindrical hole of said body casing has symmetrical catch grooves, a width of each of said catch grooves fitting with at least one tumbler of said upper lock body of a cylinder-shaped lock so as to provide the body casing with a catch function.

* * * * *